US005946828A

United States Patent [19]

Jordan et al.

[11] Patent Number: 5,946,828

[45] **Date of Patent: *Sep. 7, 1999**

[54] ATHLETIC SHOE WITH RETRACTABLE SPIKES

[75] Inventors: J. Charles Jordan, Charlotte; Clark S. Smith, Greenville, both of S.C.

[73] Assignee: J. Charles Jordan, Charlotte, N.C.

[ * ] Notice: This patent is subject to a terminal disclaimer.

[21] Appl. No.: 09/059,859

[22] Filed: Apr. 14, 1998

Related U.S. Application Data

[63] Continuation of application No. 08/560,893, Nov. 20, 1995, Pat. No. 5,737,855, which is a continuation-in-part of application No. 08/396,658, Mar. 1, 1995, Pat. No. 5,526,589.

[51] Int. Cl.[6] ..... A43C 15/00; A43C 15/08

[52] U.S. Cl. ..... 36/61; 36/67 D; 36/134

[58] Field of Search ..... 36/61, 62, 134, 36/65, 67 D, 67 R, 67 A, 59 B, 131

[56] References Cited

U.S. PATENT DOCUMENTS

| | | | |
|---|---|---|---|
| 264,105 | 9/1882 | Rust . | |
| 351,415 | 10/1886 | Weller | 36/61 |
| 659,615 | 10/1900 | Bowen | 36/61 |
| 2,034,050 | 3/1936 | Levy | 36/134 |
| 2,070,269 | 2/1937 | Goldenberg | 36/134 |
| 3,526,976 | 9/1970 | Jacobs | 36/134 |
| 3,693,271 | 9/1972 | Korpei . | |
| 3,717,238 | 2/1973 | Fox . | |
| 3,739,497 | 6/1973 | Cameron | 36/67 R |
| 3,782,011 | 1/1974 | Fisher . | |
| 3,793,751 | 2/1974 | Gordos . | |
| 4,375,729 | 3/1983 | Buchanen, III . | |
| 4,825,562 | 5/1989 | Chuang . | |
| 5,269,080 | 12/1993 | Davis . | |
| 5,299,369 | 4/1994 | Goldman . | |
| 5,737,855 | 4/1998 | Jordan et al. | 36/61 |

FOREIGN PATENT DOCUMENTS

| | | | |
|---|---|---|---|
| 1438333 | 6/1976 | United Kingdom | 36/61 |

*Primary Examiner*—M. D. Patterson
*Attorney, Agent, or Firm*—Adams Law Firm, P.A.

[57] ABSTRACT

A spiked athletic shoe includes a shoe upper, and an outsole housing connected to the shoe upper. The outsole housing includes a bottom wall with a plurality of spike-receiving openings. Spaced-apart rear and front spike plates are located within the outsole housing, and reside respectively in a rear heel portion of the shoe and a front portion of the shoe generally in an area of the ball and toes of the foot. The rear and front spike plates include a plurality of spikes attached thereto for movement between a spike-extended position whereby the plurality of spikes extend outwardly from the bottom wall of the outsole housing, and a spike-retracted position whereby the plurality of spikes are retracted within the outsole housing. A slide plate located within the outsole housing operatively engages the rear and front spike plates, and is actuated by a manually actuated lever to move the rear and front spike plates and attached spikes between the spike-retracted position and the spike-extended position.

9 Claims, 8 Drawing Sheets

ATHLETIC SHOE WITH RETRACTABLE SPIKES

This application is a 37 C.F.R. §1.53(b) continuation application of U.S. Ser. No. 08/560,893 filed Nov. 20, 1995 which application is a continuation-in-part of U.S. Ser. No. 08/396,658, filed on Mar. 1, 1995, now U.S. Pat. No. 5,526,589.

TECHNICAL FIELD AND BACKGROUND OF THE INVENTION

The invention relates to an athletic shoe with retractable spikes, and is most applicable for use by golfers, although other application to sports and events using spiked shoes is foreseeable. For example, the shoe may be used for baseball, football, hiking, logging, and the like. The invention includes means readily operable by the wearer for lifting the spikes into a retracted position within the shoe outsole, and for lowering the spikes into a spike-extended position extending outwardly from the shoe outsole. It is generally desirable to retain the spikes in the retracted position when wearing the shoes on hard surfaces or easily damaged surfaces, such as parking lots, sidewalks, wood floors, or clubhouse floors.

Conventional spiked golf shoes suffer from drawbacks and limitations. Since the spikes are secured in a fixed condition directly to the bottom surface of the shoe outsole, they remain in constant contact with the ground surface during wear. In addition to the damage caused by these shoes to hard floor surfaces, the spikes can also damage the putting greens of the golf course. As a result, there exists a need for a spiked athletic shoe wherein the spikes can be quickly and easily moved and retained in a retracted position within the shoe during wear.

The present invention addresses this need by providing a golf shoe with retractable spikes. The spikes are fully retractable within the outsole of the shoe, and remain in this position during wear until actuated by the wearer into the extended position.

SUMMARY OF THE INVENTION

Therefore, it is an object of the invention to provide a spiked athletic shoe wherein the spikes are easily movable by the wearer between a spike-extended position and a retracted position within an outsole of the shoe.

It is another object of the invention to provide a spiked athletic shoe wherein the spikes are comfortably retained in the retracted position during shoe wear.

It is another object of the invention to provide a spiked athletic shoe which will not damage golf greens or club house floors during shoe wear.

It is another object of the invention to provide a spiked athletic shoe which can be worn on hard surfaces without substantial risk of accidents and injury.

It is another object of the invention to provide a spiked athletic shoe wherein the spikes are readily removable and replaceable using a conventional tool.

It is another object of the invention to provide a spiked athletic shoe which uses conventional spikes.

It is another object of the invention to provide a spiked athletic shoe which uses permanent spikes.

It is another object of the invention to provide a spiked athletic shoe including parts which are easily removed from within the outsole of the shoe for repair or replacement as required.

It is another object of the invention to provide a spiked athletic shoe which is comfortable and durable.

These and other objects of the present invention are achieved in the preferred embodiments disclosed below by providing a spiked athletic shoe which includes a shoe upper, and an outsole housing connected to the shoe upper. The outsole housing includes a bottom wall with a plurality of spike-receiving openings.

Spaced-apart rear and front spike plates are located within the outsole housing, and reside respectively in a rear heel portion of the shoe and a front portion of the shoe generally in an area of the ball and toes of the foot. The rear and front spike plates include a plurality of spikes attached thereto for movement between a spike-extended position whereby the plurality of spikes extend outwardly from the bottom wall of the outsole housing, and a spike-retracted position whereby the plurality of spikes are retracted within the outsole housing.

A biasing means is located within the outsole housing and engages the rear and front spike plates for normally urging the rear and front spike plates and attached spikes upwardly into the spike-retracted position. An actuating means operatively engages the rear and front spike plates, and cooperates with the biasing means for moving the rear and front spike plates and attached spikes between the spike-retracted position and the spike-extended position.

According to one preferred embodiment of the invention, the actuating means includes a slide plate located within the outsole housing. The slide plate resides in overlying relation to the rear and front spike plates for controlling movement of the spike plates between the spike-retracted position and the spike-extended position.

According to another preferred embodiment of the invention, the slide plate includes a plurality of outwardly extending nubs, and the rear and front spike plates include a corresponding plurality of complementary openings. The plurality of nubs and openings cooperate upon movement of the slide plate such that upon mating alignment of the nubs and openings, the biasing means moves the rear and front spike plates and attached spikes upwardly into the spike-retracted position away from the bottom wall of the outsole housing. Upon offsetting the nubs and openings, the rear and front spike plates and attached spikes move downwardly towards the bottom wall of the outsole housing into the spike-extended position, and remain locked in the spike-extended position during shoe wear.

According to yet another preferred embodiment of the invention, the actuating means further includes a cam assembly located within the outsole housing and connected to the slide plate for moving the slide plate within the outsole housing of the shoe.

According to yet another preferred embodiment of the invention, the actuating means includes a manually actuated lever extending outwardly from the shoe. The lever is connected to the cam assembly for rotating the cam assembly within the outsole housing of the shoe.

According to yet another preferred embodiment of the invention, spaced-apart rear and front rigid caps are located adjacent to the slide plate. The caps reside respectively in the rear portion and the front portion of the outsole housing to provide a rigid barrier between the slide plate and the foot of the wearer during shoe wear, and to define an area within the outsole housing for movement of the rear and front spike plates between the spike-retracted position and the spike-extended position.

According to yet another preferred embodiment of the invention, rear and front outsole plates are located adjacent to the bottom wall of the outsole housing. The rear and front outsole plates define a plurality of screw holes therein for receiving a corresponding plurality of threaded screws for removably attaching the rear and front outsole plates to the outsole housing of the shoe.

According to yet another preferred embodiment of the invention, the rear and front caps include a respective plurality of internally-threaded spacers for receiving the plurality of threaded screws for removably attaching the bottom wall and the rear and front outsole plates to the outsole housing.

According to yet another preferred embodiment of the invention, the biasing means includes respective coil springs located between the bottom wall of the outsole housing and the rear and front spike plates for normally urging the rear and front spike plates and attached spikes upwardly into the spike-retracted position.

According to yet another preferred embodiment of the invention, a cushioned middle sole is provided for being located between the rear and front caps and the foot of the wearer during shoe wear.

According to yet another preferred embodiment of the invention, the rear and front spike plates include a plurality of internally-threaded holes therein. The plurality of spikes include respective complementary-threaded ends for being received into the holes to thereby removably attach the plurality of spikes to the rear and front spike plates.

According to one preferred embodiment of the invention, a spiked athletic shoe includes a shoe upper, and an outsole housing connected to the shoe upper. The outsole housing includes a bottom wall with a plurality of spike-receiving openings.

Spaced-apart rear, middle, and front spike plates are located within the outsole housing, and reside respectively in a rear heel portion, middle ball portion, and front toe portion of the outsole housing. The rear, middle, and front spike plates include a plurality of spikes attached thereto for movement between a spike-extended position whereby the plurality of spikes extend from the bottom wall of the outsole housing, and a spike-retracted position whereby the plurality of spikes are retracted within the outsole housing.

A biasing means is located within the outsole housing and engages the rear, middle, and front spike plates for normally urging the rear, middle, and front spike plates and attached spikes upwardly into the spike-retracted position. An actuating means operatively engages the rear, middle, and front spike plates and cooperates with the biasing means for moving the rear, middle, and front spike plates and attached spikes between the spike-retracted position and the spike-extended position.

According to another preferred embodiment of the invention, the actuating means includes a slide plate located within the outsole housing and in overlying relation to the rear, middle, and front spike plates for controlling movement of the rear, middle, and front spike plates between the spike-retracted position and the spike-extended position.

According to yet another preferred embodiment of the invention, the slide plate includes a plurality of outwardly extending nubs, and the rear, middle, and front spike plates include a corresponding plurality of complementary openings. The plurality of nubs and openings cooperate upon movement of the slide plate such that upon mating alignment of the nubs and openings, the biasing means moves the rear, middle, and front spike plates and attached spikes upwardly into the spike-retracted position away from the bottom wall of the outsole housing. Upon offsetting the nubs and openings, the rear, middle, and front spike plates and attached spikes move downwardly towards the bottom wall of the outsole housing into the spike-extended position, and remain locked in the spike-extended position during shoe wear.

According to yet another preferred embodiment of the invention, the actuating means further includes a cam assembly located within the outsole housing and connected to the slide plate for moving the slide plate within the outsole housing of the shoe.

According to yet another preferred embodiment of the invention, a manually actuated lever extends outwardly from the shoe, and connects to the cam assembly for rotating the cam assembly within the outsole housing of the shoe.

According to yet another preferred embodiment of the invention, spaced-apart rear, middle, and front rigid caps are located adjacent to the slide plate. The caps reside respectively in the rear, middle, and front portions of the outsole housing to provide a rigid barrier between the slide plate and the foot of the wearer during shoe wear, and to define an area within the outsole housing for movement of the rear, middle, and front spike plates between the spike-retracted position and the spike-extended position.

According to yet another preferred embodiment of the invention, rear, middle, and front rigid outsole plates are located adjacent to the bottom wall of the outsole housing.

According to yet another preferred embodiment of the invention, the rear, middle, and front outsole plates define a plurality of screw holes therein for receiving a corresponding plurality of threaded screws for removably attaching the rear, middle, and front outsole plates to the outsole housing of the shoe.

According to yet another preferred embodiment of the invention, the rear, middle, and front caps include a respective plurality of internally-threaded spacers for receiving the plurality of threaded screws for removably attaching the rear, middle, and front outsole plates to the outsole housing.

According to yet another preferred embodiment of the invention, the biasing means includes respective coil springs located between the bottom wall of the outsole housing and the rear, middle, and front spike plates for normally urging the rear, middle, and front spike plates and attached spikes upwardly into the spike-retracted position.

According to yet another preferred embodiment of the invention, a cushioned middle sole is provided for being located between the rear, middle, and front caps and the foot of the wearer during shoe wear.

According to yet another preferred embodiment of the invention, the rear, middle, and front spike plates include a plurality of internally-threaded holes therein. The plurality of spikes include respective complementary-threaded ends for being received into the holes to thereby removably attach the plurality of spikes to the rear, middle, and front spike plates.

DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
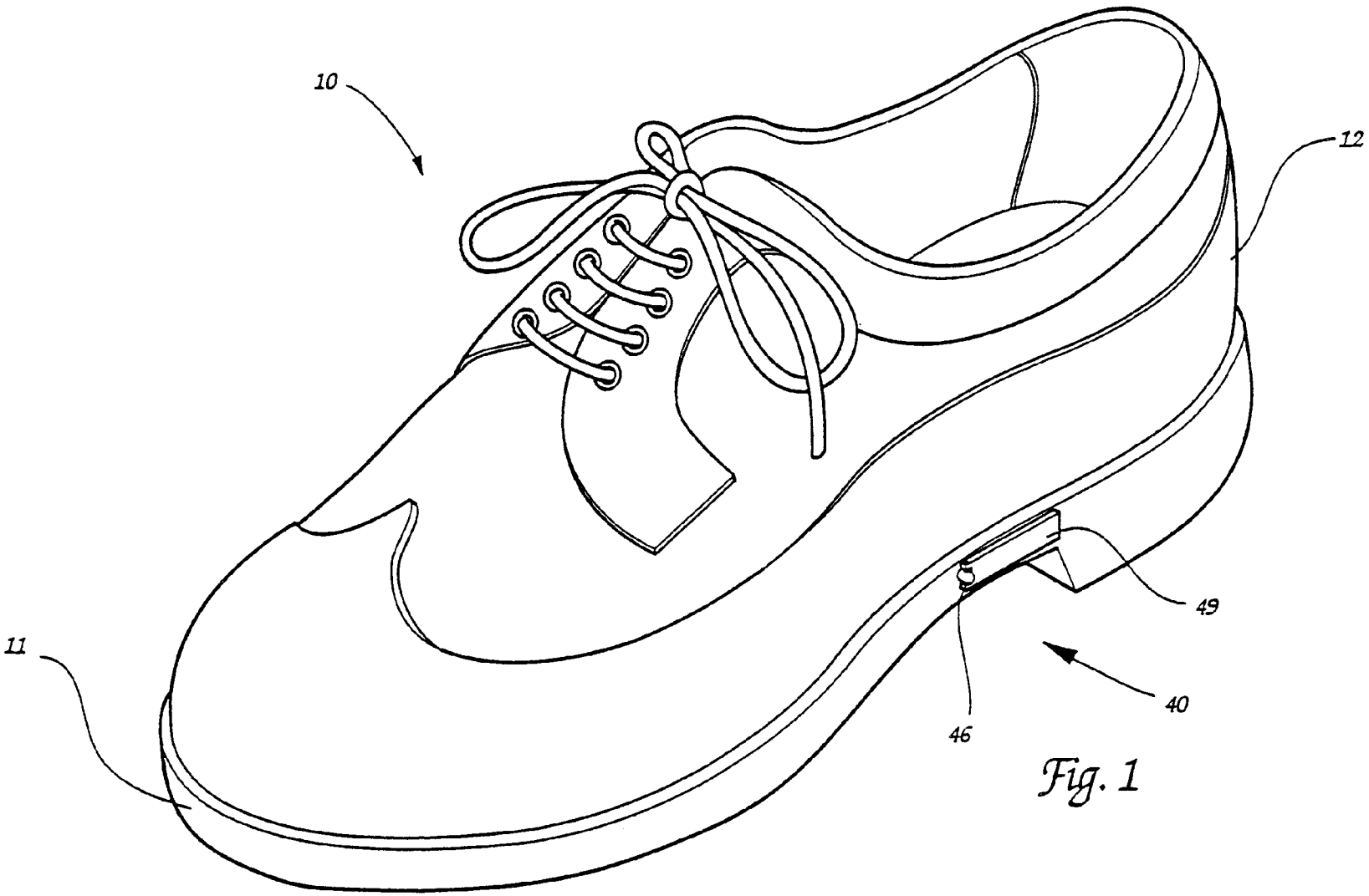
FIG. 1 is a perspective view of a spiked athletic shoe according to one preferred embodiment of the invention.

Referring now specifically to the drawings, a spiked athletic shoe according to the present invention is illustrated in FIG. 1 and shown generally at reference numeral 10. The spiked shoe 10, as shown, is for use by golfers although designs having application to other activities requiring spiked shoes is foreseeable. For example, a spiked shoe embodying the present invention may be used for baseball, football, hiking, logging, and the like. As shown in FIG. 1, the spiked shoe 10 includes an outsole housing 11, and a shoe upper 12. The shoe upper 12 is attached to the outsole housing 11 in any conventional manner, and is constructed of any suitable material, such as leather.

Figure 2:
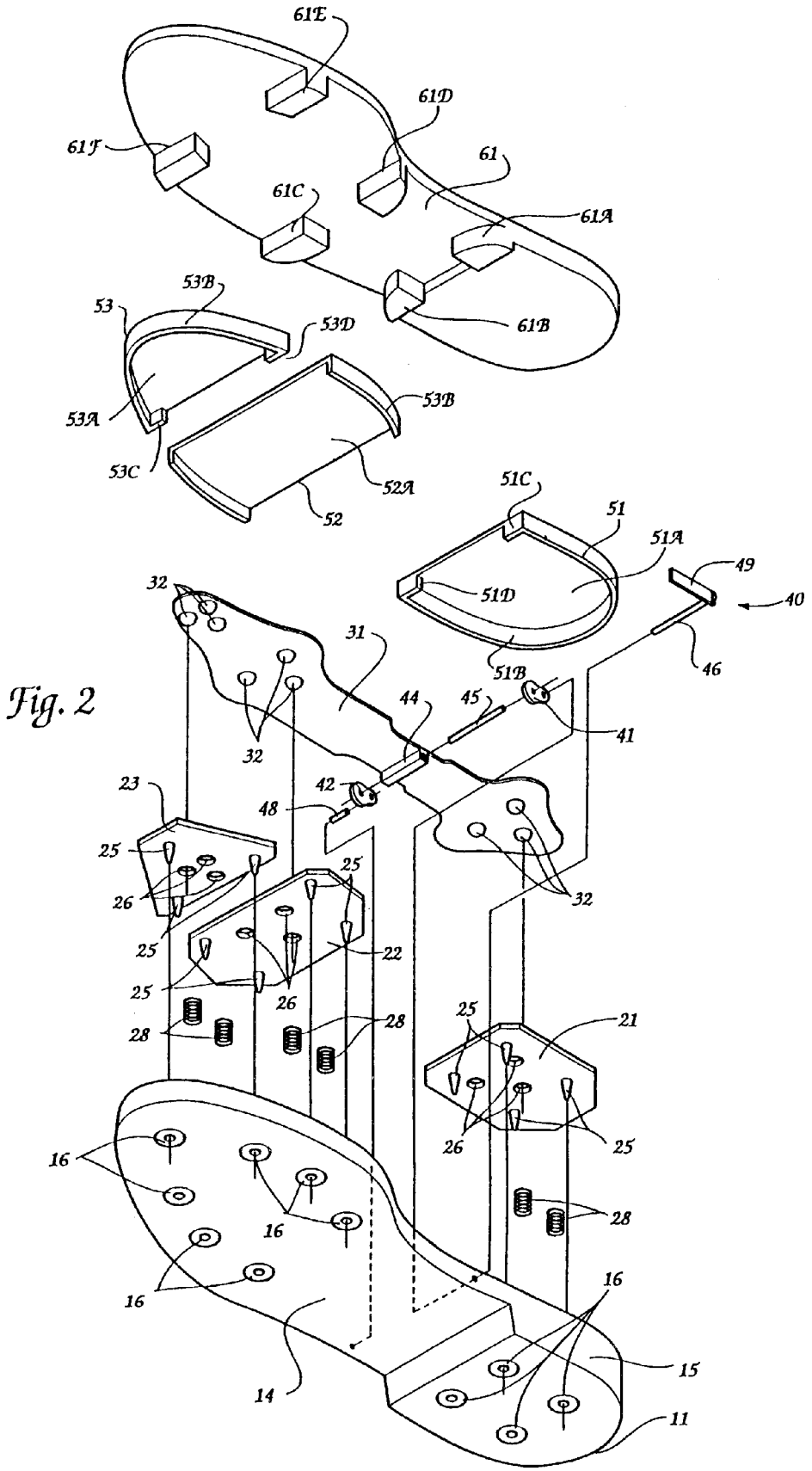
FIG. 2 is an exploded view of the outsole housing and interior components of the spiked shoe according to one preferred embodiment.
Figure 3:
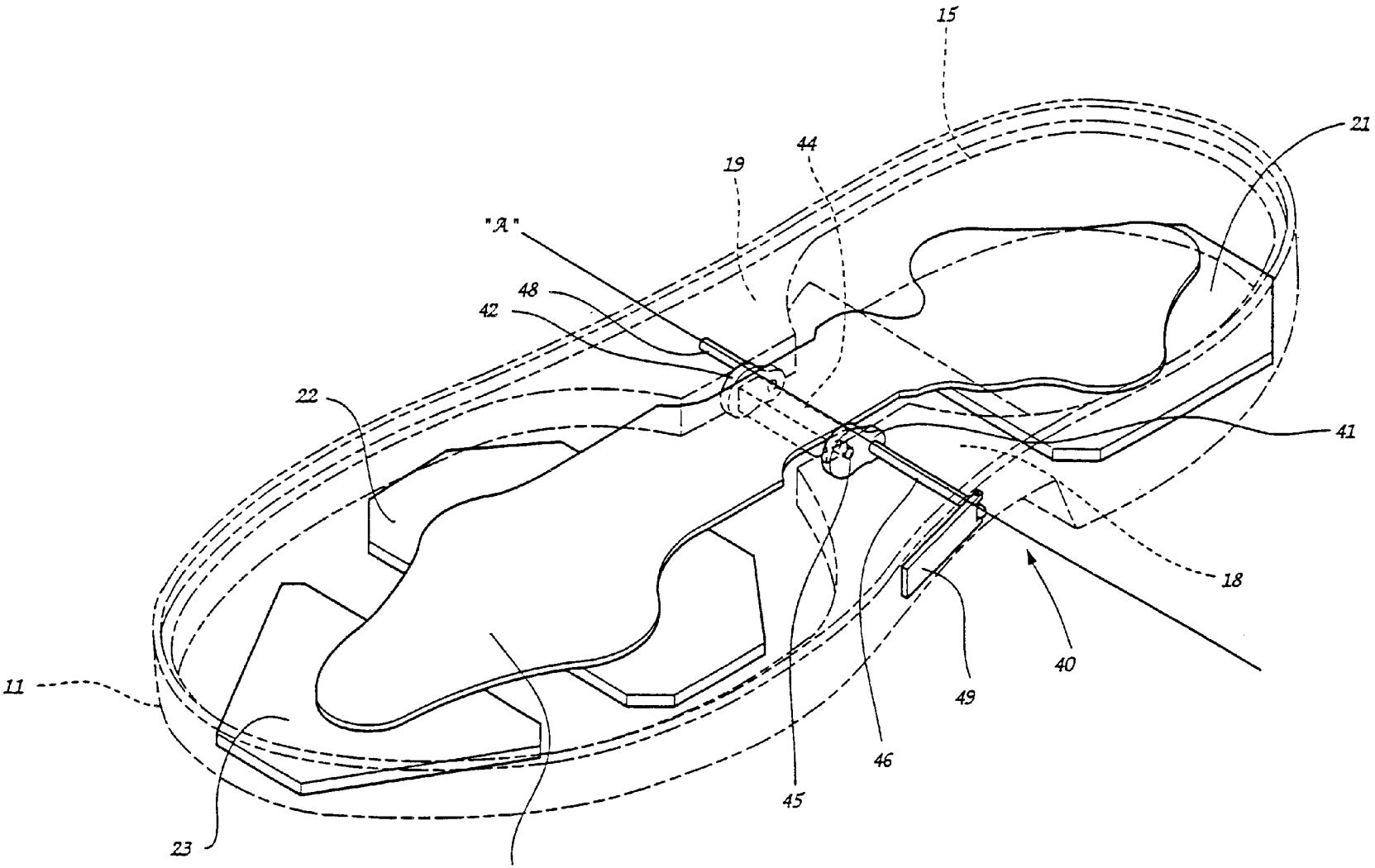
FIG. 3 is a perspective view of the cam assembly, slide plate, and spike plates of the athletic shoe, and showing the outsole housing in phantom.

The outsole housing 11 and internal components of the spiked shoe 10 are best illustrated in FIGS. 2 and 3. The outsole housing 11 is preferably formed of a durable rubber material, and includes a bottom wall 14 with integrally formed side walls 15. The bottom wall 14 is relatively thin, and includes a number of small spike openings 16. The thickness of the bottom wall 14 is preferably about 2–3 mm. The side walls 15 are relatively narrow along the rear and front portions of the outsole housing 11, and curve inwardly at a center portion to define spaced apart inner and outer mid-sections 18 and 19 of wider dimension. As shown in FIG. 3, the rear and front portions of the outsole housing 11 and the open space between the mid-sections 18 and 19 define respective recessed areas for housing the internal components of the spiked shoe 10.

Figure 4:
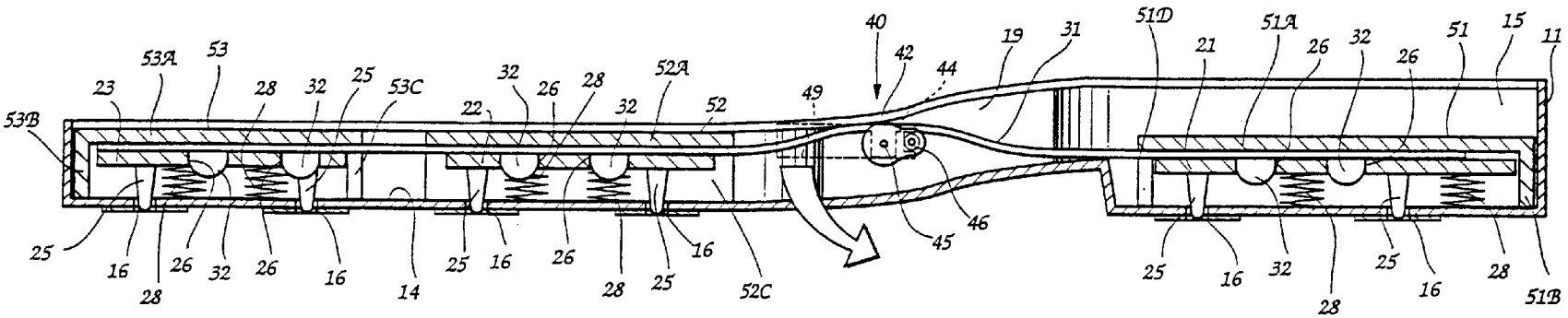
FIG. 4 is a longitudinal cross-sectional view of the outsole housing and interior components of the athletic shoe, and showing the spike plates and attached spikes located in the spike-retracted position within the outsole housing.
Figure 6:
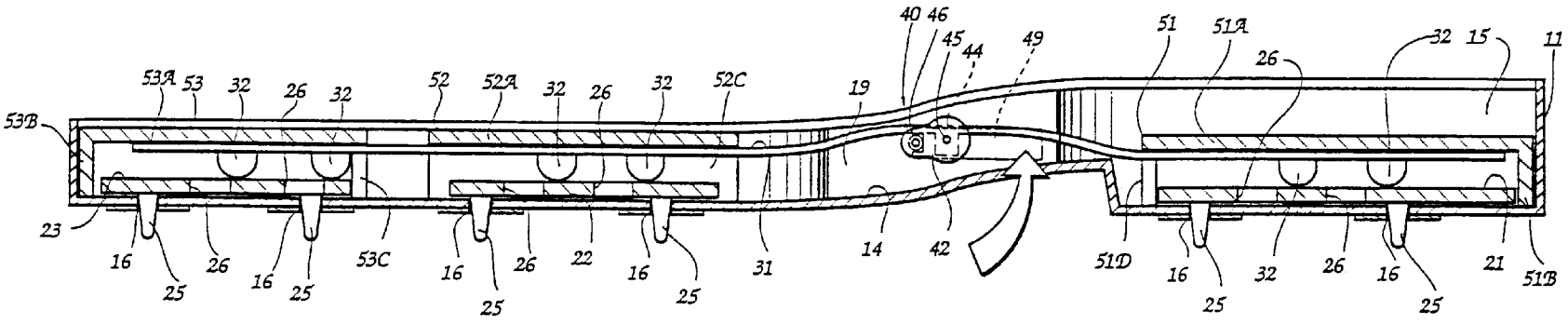
FIG. 6 is a longitudinal cross-sectional view of the outsole housing and interior components of the athletic shoe, and showing the spike plates and attached spikes located in the spike-extended position.

Rear, middle, and front rigid spike plates 21, 22, and 23 including attached spikes 25 and nub-receiving openings 26 are located within the outsole housing 11 generally in an area of the heel, ball, and toe of the shoe 10. As described further below, the spike plates 21, 22, and 23 are readily movable by the shoe wearer between a spike-extended position and a spike-retracted position, as illustrated in FIGS. 4 and 6, respectively. Small coil springs 28, or other suitable biasing means, such as leaf springs or resilient foam inserts, are located between the bottom wall 14 of the outsole housing 11 and the spike plates 21, 22, and 23 for normally urging the spike plates 21, 22, and 23 and attached spikes 25 upwardly into the spike-retracted position shown in FIG. 4.

A relatively flexible slide plate 31 is positioned in overlying relation to the spike plates 21, 22, and 23 opposite the attached spikes 25, and includes a number of protruding solid nubs 32 for being selectively aligned with and offset from the openings 26 formed in the spike plates 21, 22, and 23. When the nubs 32 and holes 26 are in vertical mating alignment, the springs 28 force the spike plates 21, 22, and 23 and attached spikes 25 upwardly away from the bottom wall 14 of the outsole housing 11, and into the spike-retracted position. When offset from the openings 26, as shown in FIG. 6, the nubs 32 of the slide plate 31 force the spike plates 21, 22, and 23 downwardly against the bottom wall 14 of the outsole housing 11 thereby moving the spikes 25 into the spike-extended position.

A cam assembly 40 secured to the slide plate 31 operates to shift the slide plate 31 longitudinally within the outsole housing 11 to move the attached nubs 32 into and out of the openings 26 of the spike plates 21, 22, and 23. As shown in FIGS. 2 and 3, the cam assembly 40 includes first and second spaced apart cams 41 and 42 located on opposite sides of the slide plate 31, and adjacent to the inner and outer mid-sections 18 and 19 of the outsole housing 11. A hollow shaft housing 44 is attached to a bottom side of the slide plate 31, and receives a connecting shaft 45 for fixedly interconnecting the first and second cams 41 and 42 together.

A lever shaft 46 extends through the inner mid-section 18 of the outsole housing 11, and is fixedly secured to the first cam 41. The second cam 42 is connected to a pivot shaft 48 received and held within the outer mid-section 19. The lever shaft 46 and pivot shaft 48 are disposed in substantial linear alignment, and define a notional pivot axis "A" about which the first and second cams 41 and 42 rotate in unison. An actuating lever 49 connected to a free end of the lever shaft 46 and located outside of the outsole housing 11 is manually actuated by the shoe wearer to rotate the cams 41 and 42 within the outsole housing 11. Operation of the cam assembly 40 and slide plate 31 is described in detail below with reference to FIGS. 4, 5, and 6.

Preferably, separate rear, middle, and front rigid caps 51, 52, and 53, respectively, are placed over the slide plate 31 in areas of the respective spike plates 21, 22, and 23 to support the foot of the shoe wearer above the slide plate 31 and spike plates 21, 22, and 23, and to define a ceiling for movement of the spike plates 21, 22, and 23 within the outsole housing 11 between the spike-retracted position and the spike-extended position. The rear cap 51 resides in a heel portion of the shoe 10, and includes a top wall 51A with an integrally molded downward extending flange 51B. The rear cap flange 51B further includes inwardly-turned front edges 51C and 51D for added support strength. The middle cap 52 resides generally in an area adjacent the ball of the foot, and includes a top wall 52A with opposing side flanges 52B and 52C. The front cap 53 resides in the toe portion of the shoe 10, and includes a top wall 53A and flange 53B. The front cap flange 53B further includes inwardly-turned edges 53C and 53D for providing added support strength.

In addition, the spiked shoe 10 preferably includes a flexible cushioned middle sole 61 located adjacent to the caps 51, 52, and 53, and including several enlarged areas 61A, 61B, 61C, 61D, 61E, and 61F formed on a bottom side thereof shaped to fit between the caps 51, 52, and 53, and to accommodate the space required for the slide plate 31. The middle sole 61 further serves to maintain proper spacing between adjacent caps 51, 52, and 53 and adjacent spike plates 21, 22, and 23.

Operation of the Cam Assembly 40 and Slide Plate 31

Figure 5:
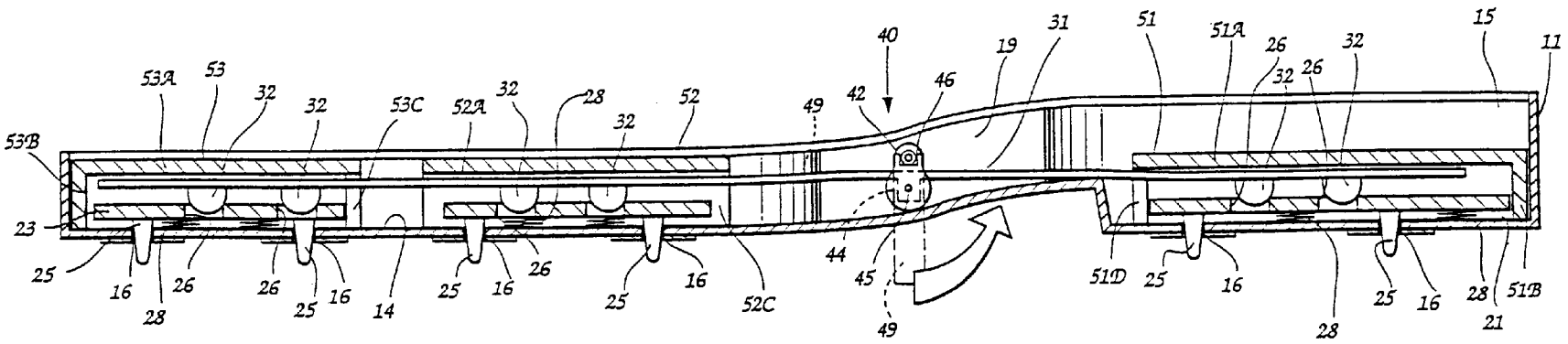
FIG. 5 is a longitudinal cross-sectional view of the outsole housing and interior components of the athletic shoe, and showing the spike plates and attached spikes located midway between the spike-retracted and the spike-extended position.

FIGS. 4, 5, and 6 illustrate operation of the cam assembly 40 and slide plate 31, and sequential movement of the rear, middle, and front spike plates 21, 22, and 23 from the spike-retracted position to the spike-extended position. As shown in FIG. 4, the nubs 32 of the slide plate 31 and openings 26 of the rear, middle, and front spike plates 21, 22, and 23 are in substantial vertical alignment. The springs 28 urge the spike plates 21, 22, and 23 and attached spikes 25 upwardly into the spike-retracted position. To move the spike plates 21, 22, and 23 and attached spikes 25 downwardly into the spike-extended position, the wearer manually pivots the lever 49 in the direction indicated in FIG. 4.

Referring to FIG. 5, the first and second cams 41 and 42 rotate in unison substantially 90° C. about the notional pivot axis "A" as the lever 49 is pivoted in a counterclockwise direction to a vertically down position. The cam connecting shaft 45 and shaft housing 44 attached to the slide plate 31 cooperate to shift the slide plate 31 slightly towards the heel of the shoe 10, while the nubs 32 begin to surface from within the openings 26 of the spike plates 21, 22, and 23. As the nubs 32 engage the spike plates 21, 22, and 23, the slide plate 31 is forced upwardly against the top walls 51A, 52A, and 53A of respective caps 51, 52, and 53. The fixed ceiling provided by the caps 51, 52, and 53 causes the nubs 32 to force the spike plates 21, 22, and 23 downwardly against the biasing force of the springs 28. Continued pivoting movement of the lever 49 and cams 41 and 42 in a counterclockwise direction further shifts the slide plate 31 towards the heel of the shoe 10, thereby causing the spike plates 21, 22, and 23 and attached spikes 25 to move downwardly into their fully extended position.

As shown in FIG. 6, the lever 49 and cams 41, 42 have rotated substantially 180° from their original positions. The nubs 32 of the slide plate 31 are entirely offset from the openings 26 of the spike plates 21, 22, and 23, and act to maintain the spike plates 21, 22, and 23 and attached spikes 25 in the spike-extended position during shoe wear. The springs 28 are fully compressed.

To return the spike plates 21, 22, and 23 to the spike-retracted position, the shoe wearer pivots the lever 49 substantially 180° in a reverse, clockwise direction. The slide plate 31 shifts towards the toe of the shoe 10, and the nubs 32 realign with the openings 26 of the spike plates 21, 22, and 23. The springs 28 again urge the spike plates 21, 22, and 23 and attached spikes 25 upwardly away from the bottom wall 14 of the outsole housing 11 and into their fully retracted position.

Preferably, the attached spikes 25 of the spike plates 21, 22, and 23 are permanent, wear-resistant metal spikes with ceramic tips which do not require repair or replacement during the life of the shoe. One such spike is that manufactured by MacNeil Engineering of Marlboro, Mass., and sold under the trademark "Cermac".

Figure 7:
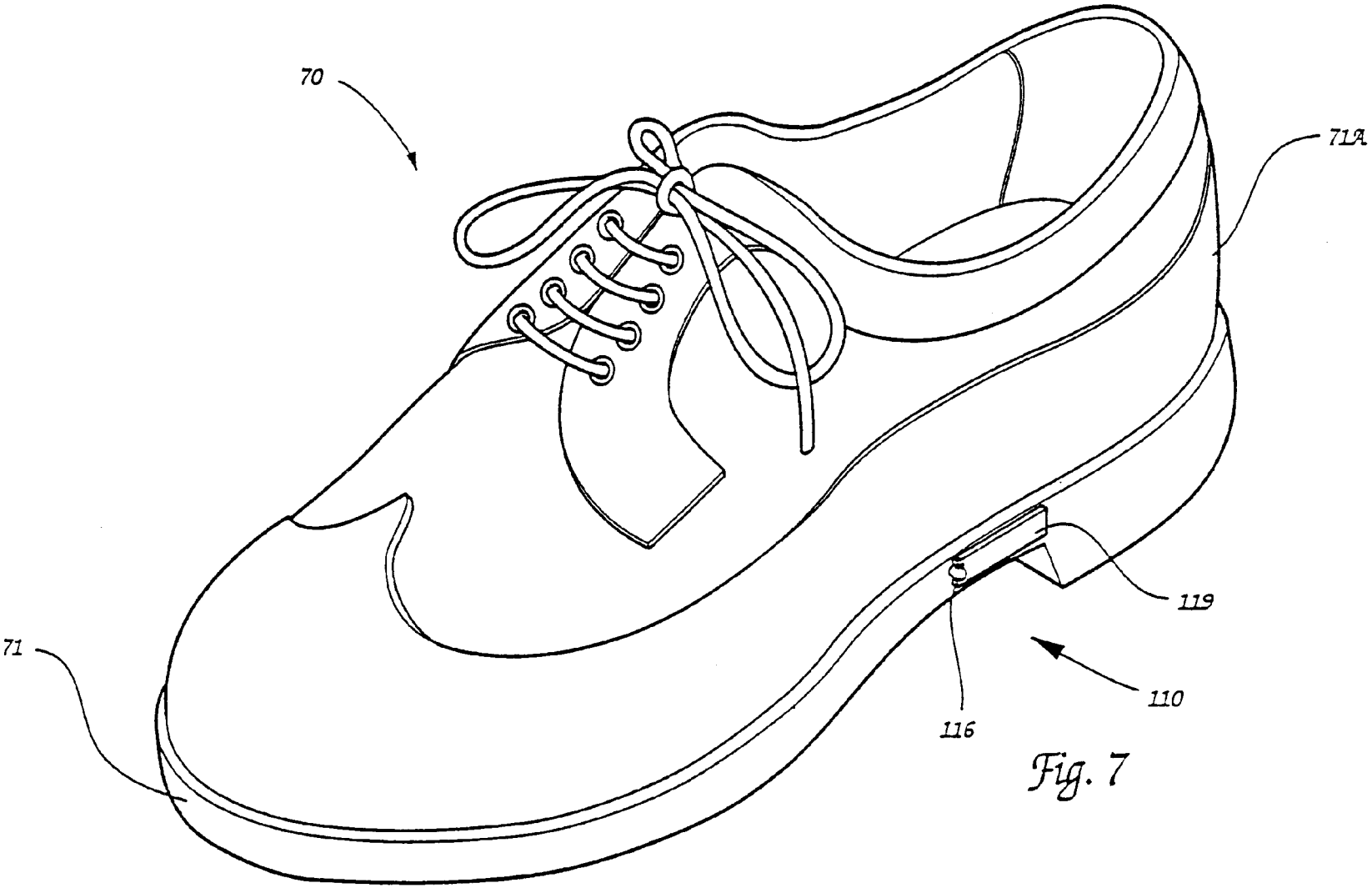
FIG. 7 is a perspective view of a spiked athletic shoe according to a second preferred embodiment of the invention.
Figure 8:
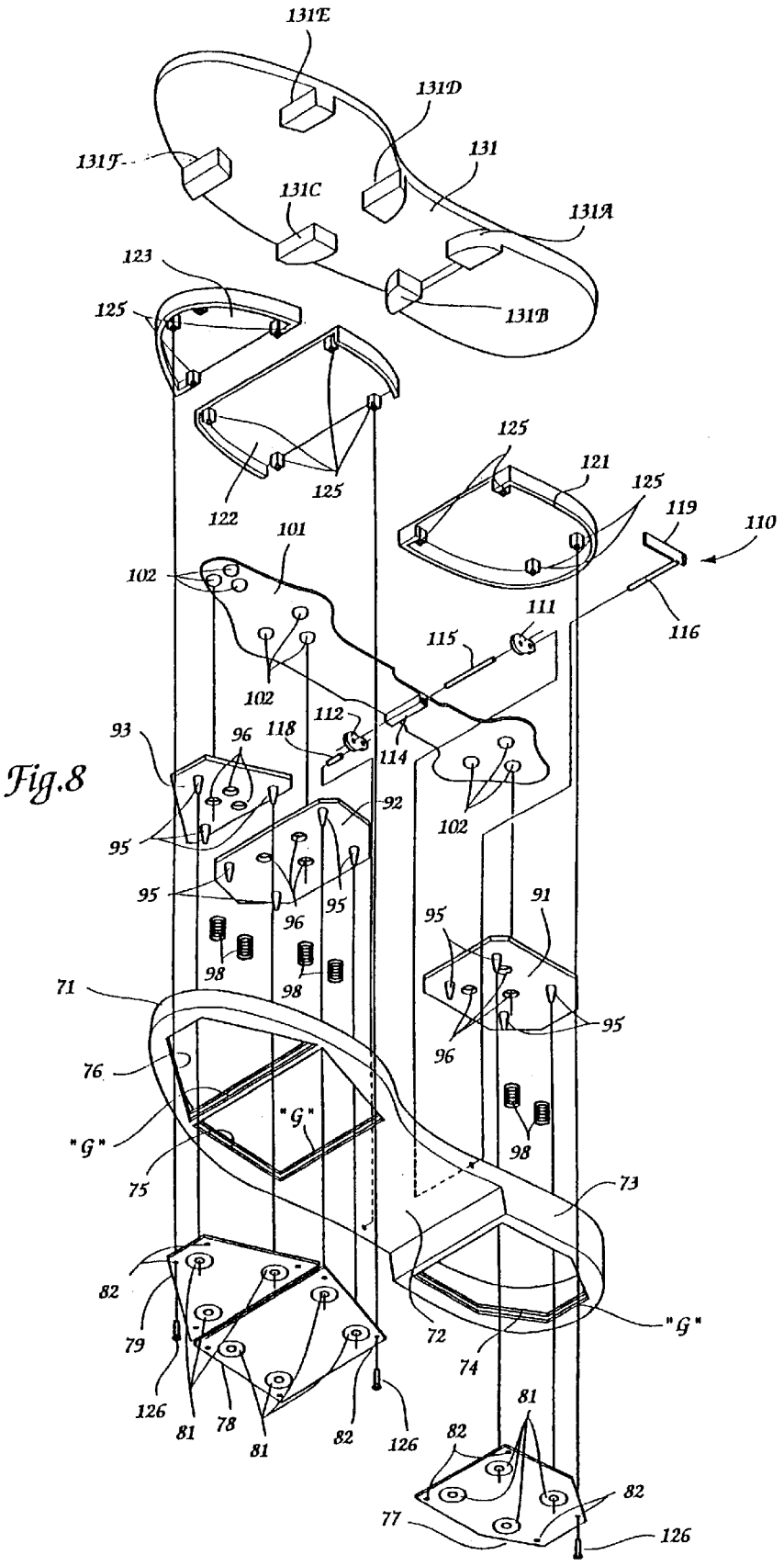
FIG. 8 is an exploded view of the outsole housing and interior components of the spiked shoe according to the second preferred embodiment of the invention.

A second embodiment of a spiked athletic shoe 70 with outsole housing 71 and shoe upper 71A is illustrated in FIGS. 7 and 8. The outsole housing 71 includes a bottom wall 72 and side walls 73. The bottom wall 72 defines cut-out areas 74, 75, and 76 located generally in a heel, ball, and toe portion of the shoe 70 for receiving complementary shaped outsole plates 77, 78, and 79. The outsole plates 77, 78, and 79 include openings 81 therein for accommodating spikes, and small screw holes 82 located about their respective perimeters.

Rear, middle, and front rigid spike plates 91, 92, and 93 including attached spikes 95 and nub-receiving openings 96 are located within the outsole housing 71 generally in an area of the heel, ball, and toe of the shoe. Small coil springs 98, or other suitable biasing means, are located between the respective outsole plates 77, 78, and 79 and the spike plates 91, 92, and 93 for normally urging the spike plates 91, 92, and 93 and attached spikes 95 upwardly into the spike-retracted position.

A relatively flexible slide plate 101 is positioned in overlying relation to the spike plates 91, 92, and 93 opposite the attached spikes 95, and includes a number of protruding solid nubs 102 for being selectively aligned with and offset from the openings 96 formed in the spike plates 91, 92, and 93. A cam assembly 110 secured to the slide plate 101 operates to shift the slide plate 101 longitudinally within the outsole housing 71 to move the attached nubs 102 into and out of the openings 96 of the spike plates 91, 92, and 93.

The cam assembly 110 includes first and second spaced apart cams 111 and 112 located on opposite sides of the slide plate 101. A hollow shaft housing 114 is attached to a bottom side of the slide plate 101, and receives a connecting shaft 115 for fixedly interconnecting the first and second cams 111 and 112 together. A lever shaft 116 is fixedly secured to the first cam 111, while the second cam 112 is connected to a pivot shaft 118. An actuating lever 119 connected to a free end of the lever shaft 116 and located outside of the outsole housing 71 is manually actuated by the shoe wearer to rotate the cams 111 and 112 in unison within the outsole housing 71. Operation of the cam assembly 110 and slide plate 101 is identical to that described above with reference to FIGS. 4, 5, and 6.

Separate rear, middle, and front rigid caps 121, 122, and 123 are placed over the slide plate 101 in areas of the respective spike plates 91, 92, and 93 to support the foot of the shoe wearer above the slide plate 101 and spike plates 91, 92, and 93, and to define a ceiling for movement of the spike plates 91, 92, and 93 within the outsole housing 71 between the spike-retracted position and the spike-extended position. Each cap 121, 122, and 123 includes a number of internally threaded spacers 125 for receiving threaded screws 126 upwardly through the holes 82 formed in respective outsole plates 77, 78, and 79 to thereby removably attach the outsole plates 77, 78, and 79 to the caps 121, 122, and 123 with the slide plate 101 and spike plates 91, 92, and 93 located therebetween. A slight groove "G" is formed along the of each cut-out 73, 74, and 75 in the bottom wall 74 of the outsole housing 71 to provide a water tight seal between the outsole plates 77, 78, and 79 and the outsole housing 71.

The removable attachment of the outsole plates 77, 78, and 79 permits access by the wearer to the internal components of the shoe 70 housed within the outsole housing 71. Thus, the spikes 95 of the spike plates 91, 92, and 93 may be conventional replaceable spikes with externally threaded ends for being received into internally threaded openings formed in the spike plates 91, 92, and 93.

In addition, a cushioned middle sole 131 is preferably located adjacent to the caps 121, 122, 123, and includes several enlarged areas 131A, 131B, 131C, 131D, 131E, and 131F shaped to fit between the caps 121, 122, and 123 and to accommodate the space required for the slide plate 101. The cushioned middle sole 131 further serves to maintain proper spacing between adjacent caps 121, 122, and 123, and adjacent spike plates 91, 92, and 93.

A spiked athletic shoe is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An athletic shoe, comprising:

(a) a shoe upper;

(b) an outsole housing adjacent the shoe upper, and comprising at least one removable outsole plate including a plurality of spike openings therein;

(c) at least one retractable spike plate positioned within said outsole housing adjacent said at least one outsole plate, and carrying a plurality of outward-extending spikes adapted for movement through said spike openings between an extended position and a retracted position;

(d) at least one support cap positioned within said outsole housing, and including a top wall and side walls defining an open space there between, said top wall being vertically spaced-apart from said at least one outsole plate a distance sufficient to accommodate movement of said spike plate and spikes between the extended position and the retracted position; and (e) attachment means for removably attaching said at least one outsole plate to said outsole housing.

2. An athletic shoe according to claim 1, wherein said at least one support cap includes a plurality of internally-threaded openings therein, and wherein said at least one outsole plate includes a corresponding plurality of openings aligned with the openings of said support cap and adapted for receiving a plurality of externally-threaded fasteners for removably attaching said at least one outsole plate to said outsole housing.

3. An athletic shoe according to claim 1, wherein said outsole housing includes a bottom wall defining at least one cut-out area for receiving said at least one outsole plate.

4. An athletic shoe according to claim 3, and comprising a groove formed in said bottom wall along a perimeter of said at least one cut-out area for holding said at least one outsole plate and providing a seal between said outsole plate and said outsole housing.

5. An athletic shoe, comprising:

(a) a shoe upper;

(b) an outsole housing adjacent the shoe upper, and comprising front, middle, and rear removable outsole plates adapted for residing generally in an area of the toe, ball, and heel of the shoe, respectively, and each of said outsole plates including a plurality of spike openings therein;

(c) at least one retractable spike plate positioned within said outsole housing adjacent said front, middle and rear outsole plates, and carrying a plurality of outward-extending spikes adapted for movement through said spike openings between an extended position and a retracted position;

(d) at least one support cap positioned within said outsole housing, and including a top wall and side walls defining an open space there between, said top wall being vertically spaced-apart from said front, middle, and rear outsole plates a distance sufficient to accommodate movement of said spike plate and spikes between the extended position and the retracted position; and (e) attachment means for removably attaching said front, middle, and rear outsole plates to said outsole housing.

6. An athletic shoe according to claim 5, and comprising front, middle, and rear support caps positioned in said outsole housing adjacent said front, middle, and rear outsole plates.

7. An athletic shoe according to claim 6, wherein said front, middle, and rear support caps include a respective plurality of internally-threaded openings therein, and wherein said front, middle, and rear outsole plates include a corresponding plurality of openings aligned with the openings of said support caps and adapted for receiving a plurality of externally-threaded fasteners for removably attaching said front, middle, and rear outsole plates to said outsole housing.

8. An athletic shoe according to claim 5, wherein said outsole housing includes a bottom wall defining a plurality of cut-out areas for receiving said front, middle, and rear outsole plates.

9. An athletic shoe according to claim 8, and comprising a groove formed in said bottom wall along a perimeter of each of said cut-out areas for holding said outsole plate and providing a seal between said outsole plate and said outsole housing.

* * * * *